US008585248B1

(12) United States Patent
Isaacson

(10) Patent No.: US 8,585,248 B1
(45) Date of Patent: Nov. 19, 2013

(54) LED LUMINAIRE HAVING HEAT SINKING PANELS

(75) Inventor: Chris Isaacson, Encinitas, CA (US)

(73) Assignee: NuLEDs, Inc., Vista, CA (US)

( * ) Notice: Subject to any disclaimer, the term of this patent is extended or adjusted under 35 U.S.C. 154(b) by 162 days.

(21) Appl. No.: 13/209,393

(22) Filed: Aug. 13, 2011

Related U.S. Application Data

(60) Provisional application No. 61/374,256, filed on Aug. 16, 2010.

(51) Int. Cl.
*F21V 29/00* (2006.01)

(52) U.S. Cl.
USPC ..... 362/294; 362/341; 362/345

(58) Field of Classification Search
USPC ..... 362/294, 545, 547, 249.02, 345; 257/98, 100, 712; 174/252
See application file for complete search history.

(56) References Cited

U.S. PATENT DOCUMENTS 3,911,327 A 10/1975 Murari et al.
4,774,632 A * 9/1988 Neugebauer ..... 361/715
5,065,279 A 11/1991 Lazenby et al.
6,541,800 B2 * 4/2003 Barnett et al. ..... 257/98
6,603,665 B1 8/2003 Truong et al.
6,964,499 B2 * 11/2005 Colip et al. ..... 362/244
7,198,386 B2 * 4/2007 Zampini et al. ..... 362/294
7,498,610 B2 * 3/2009 Kim et al. ..... 257/99
7,723,747 B2 * 5/2010 Koo et al. ..... 257/100
7,808,004 B2 * 10/2010 Sun et al. ..... 257/79
8,129,744 B2 * 3/2012 Koo et al. ..... 257/100
8,279,608 B2 * 10/2012 Chen ..... 361/719
2004/0075100 A1 4/2004 Bogner et al.
2006/0203510 A1 * 9/2006 Noh et al. ..... 362/580
2009/0085047 A1 4/2009 Livesay et al.
2009/0194868 A1 * 8/2009 Chong et al. ..... 257/712

* cited by examiner

*Primary Examiner* — Ali Alavi
(74) *Attorney, Agent, or Firm* — Robroy R. Fawcett

(57) ABSTRACT

Disclosed is a luminaire comprising a plurality of side heat sinking panels, a plurality of circuit boards, and a middle heat sinking panel having a plurality of side apertures and having a diffusely reflective surface. Each printed circuit board has an electrically-insulated back surface and has a selectively electrically-insulated front surface having exposed electrical contacts coupled to light emitting diodes. Each printed circuit board is sandwiched between a respective side heat sinking panel and the middle heat sinking panel with a compressive force and with at least one light emitting diode associated with each side aperture directing light toward the diffusely reflective surface for illumination of an area facing the diffusely reflective surface.

20 Claims, 5 Drawing Sheets

LED LUMINAIRE HAVING HEAT SINKING PANELS

CROSS-REFERENCE TO RELATED APPLICATION

This application claims the benefit of U.S. Provisional Application No. 61/374,256, filed Aug. 16, 2010, which application is incorporated herein by reference.

BACKGROUND OF THE INVENTION

1. Field of the Invention

The present invention relates to luminaires, for light-emitting diode (LED) illumination, having efficient thermal dissipation.

2. Description of the Prior Art and Related Information

Commercial spaces often employ overhead recessed fluorescent lighting. Such recessed lighting is becoming less efficient than newer alternatives, and often use hazardous materials such as mercury.

Further, fluorescent lights generally lack adequate dimming capability. Accordingly, either all of the lights remain on, or dimming is somewhat accomplished by shutting off banks of lights, or by using expensive, step-wise, dimming ballasts.

Other LED downlight alternatives have exhibited high glare from direct view of the LEDs. Diffusing lenses often absorb too much light to compete in efficiency.

There is, therefore, a need for an improved luminaire for efficient illumination.

SUMMARY OF THE INVENTION

The present invention may be embodied in a luminaire comprising a plurality of side heat sinking side panels, a plurality of printed circuit boards, and a middle heat sinking panel having a plurality of side apertures and having a diffusely reflective surface. Each printed circuit board has an electrically-insulated back surface and has a selectively electrically-insulated front surface having exposed electrical contacts coupled to light emitting diodes. Each printed circuit board is sandwiched between a respective side heat sinking panel and the middle heat sinking panel with a compressive force and with at least one light emitting diode associated with each side aperture directing light toward the diffusely reflective surface for illumination of an area facing the diffusely reflective surface.

In more detailed features of the invention, each printed circuit board may be a flexible printed circuit board. Each printed circuit board may have a solder mask layer on the front surface, a front copper layer comprising the exposed electrical contacts, an electrically insulative polyimide layer, a rear copper layer, and a solder mask layer on the back surface. The front copper layer may include at least one thermal contact for thermally coupling to a light emitting diode. The rear copper layer may have an area substantially equal to an area of the electrically-insulated back surface. Each of the front and rear copper layers may comprise 3 ounce per square foot copper. The front and rear copper layers are not in electrical contact with the heat sinking panels. Alternatively, each printed circuit board may have a solder mask layer on the front surface, a front copper layer comprising the exposed electrical contacts, an electrically insulative polyimide layer, and a rear aluminum layer on the back surface. Each light emitting diode may emit at least 60 lumens of visible light using an electrical input of 1.5 watts.

The present invention also may be embodied in a luminaire comprising a plurality of side heat sinking panels, a middle heat sinking panel including a diffusely reflective surface, and a plurality of printed circuit boards. Each side heat sinking panel has a plurality of apertures. Each printed circuit board has an electrically-insulated back surface and has a selectively electrically-insulated front surface having exposed electrical contacts coupled to light emitting diodes. Each first printed circuit board is sandwiched between a respective side heat sinking panel and the middle heat sinking panel with a compressive force and with at least one light emitting diode associated with each aperture directing light toward the diffusely reflective surface for illumination of an area facing the diffusely reflective surface.

At least a portion of the diffusely reflective surface may have a curved shape, a faceted shape, or a shape of a pyramid. In addition, at least a portion of the diffusely reflective surface may be an enclosure cover that may be removable from the middle heat sinking panel for access to an enclosure. The luminaire may further include a lens in at least a portion of an illumination opening formed by the middle heat sinking panel and the plurality of side heat sinking panels.

In addition, the present invention may be embodied in a luminaire comprising a heat sinking panel including a diffusely reflective surface, and a plurality of printed circuit boards. Each printed circuit board may have a selectively electrically-insulated front surface having exposed electrical contacts coupled to light emitting diodes. Also, each printed circuit board may have a back surface that is electrically isolated from the front surface. The back surface of each printed circuit board may be thermally coupled to the heat sinking panel with the light emitting diodes directing light toward the diffusely reflective surface for illumination of an area facing the diffusely reflective surface.

BRIEF DESCRIPTION OF THE DRAWINGS

The accompanying drawings illustrate embodiments of the present invention and, together with the description, serve to explain the principles of the invention.

DETAILED DESCRIPTION

Figure 1:
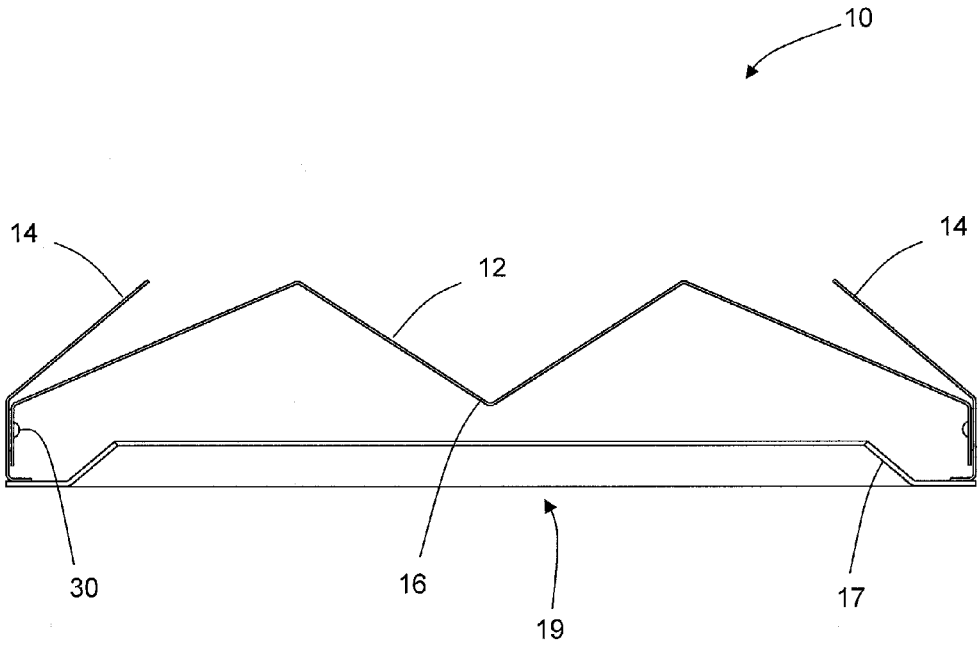
FIG. 1 is a cross-sectional view of a first embodiment of a luminaire having side heat sinking panels and a middle heat sinking panel, according to the present invention.
Figure 2:
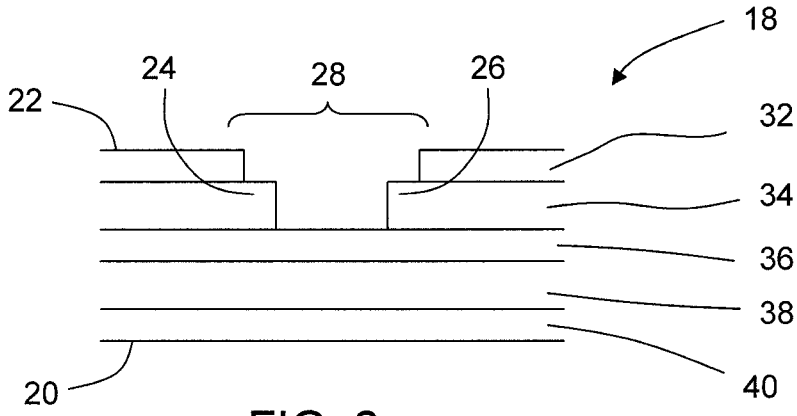
FIG. 2 is a cross-sectional view of a first embodiment of a printed circuit board, according to the present invention.
Figure 4:
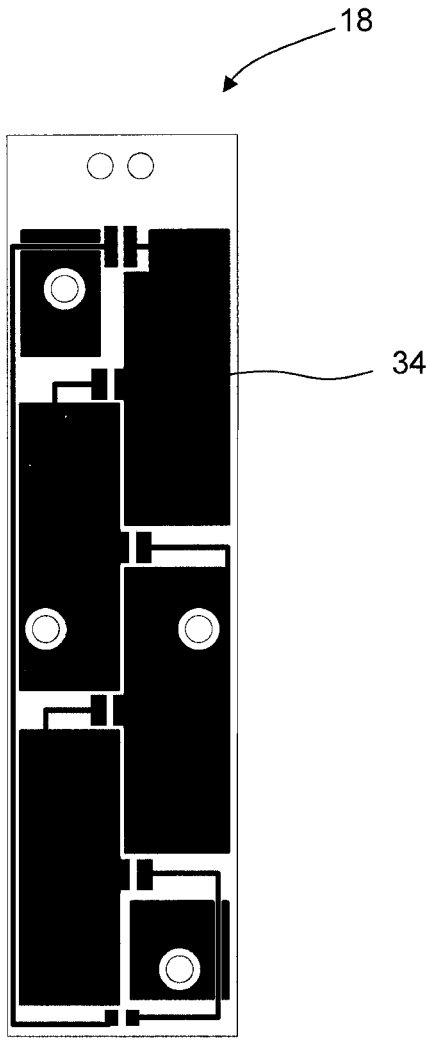
FIG. 4 is a layout of a front copper layer of a printed circuit board.

With reference to FIGS. 1, 2 and 4, the present invention may be embodied in a luminaire 10 comprising a plurality of side heat sinking panels 14 a plurality of printed circuit boards 18, and a middle (or center) heat sinking panel 12 having a plurality of side apertures and having a diffusely reflective surface 16. Each printed circuit board has an electrically-insulated back surface 20 and has a selectively electrically-insulated front surface 22 having exposed electrical contacts, 24 and 26, coupled to light emitting diodes 30 (mounted in area 28). Each printed circuit board is sandwiched between a respective side heat sinking panel and the middle heat sinking panel with a compressive force and with at least one light emitting diode associated with each side aperture directing light toward the diffusely reflective surface for illumination of an area facing the diffusely reflective surface. The heat sinking panels may have shapes other than a flat surface, e.g., curved or faceted. Also, each heat sinking panel may have multiple smaller panels that are mechanically and thermally coupled to form the respective heat sinking panel. In this embodiment, the circuit boards are on an outside surface of the middle heat sinking panel.

At the bottom of the luminaire 10 is a part 17 (with the 45 degree bend) can be a reflective surface (reflecting up) or partially reflective (reflecting up) and partially transmissive (allowing light through downward). This part 17 may also be a curved or faceted lens to provide alternative light distribution in the space below. An opening 19 allows light to exit the luminaire. Generally, the luminaire includes four side heat sinking panels 14 such that the center of the middle heat sinking panel 12 has the appearance of an inverted pyramid, for providing an even distribution of light.

Each printed circuit board 18 may be a flexible printed circuit board. Each printed circuit board may have a solder mask layer 32 on the front surface 22, a front copper layer 34 comprising the exposed electrical contacts, 24 and 26, an electrically insulative polyimide layer 36, a rear copper layer 38, and a solder mask layer on the back surface 40. The front copper layer may include at least one thermal contact for thermally coupling to a light emitting diode. The rear copper layer may have an area substantially equal to an area of the electrically-insulated back surface. Each of the front and rear copper layers may comprise 3 ounce per square foot copper (about 107 microns thick). The front and rear copper layers are not in electrical contact with the heat sinking panels 12 and 14. Each light emitting diode may emit at least 60 lumens of visible light using an electrical input of 1.5 watts.

Figure 3:
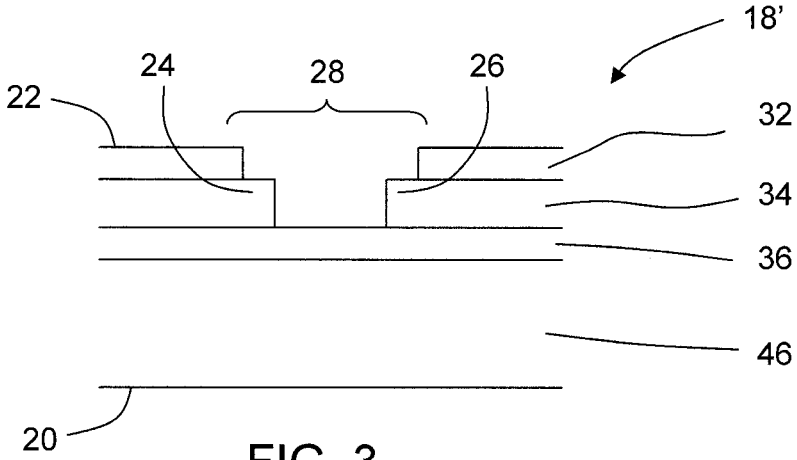
FIG. 3 is a cross-sectional view of a second embodiment of a printed circuit board, according to the present invention.

With reference to FIG. 3, in an alternative embodiment, each printed circuit board 18' may have a solder mask layer 32 on the front surface 22, a front copper layer 34 comprising the exposed electrical contacts, 24 and 26, an electrically insulative polyimide layer 36, and a rear aluminum layer 46 on the back surface 20.

Each printed circuit board may be removable and very thin. Each of the panels, 12 and 14, may provide conductive and convective heat sinking.

Thus, by using dual or parallel thermal paths to the heat sinking panels of the respective sandwich through the front surface 22 and through the back surface 20 of the printed circuit board 18, the equivalent thermal resistance to ambient may be significantly reduced. Also, the relatively thick and large surface areas on the front copper layer, thermally connected to the thermal junction of the LED (often the LED cathode), along with a relatively thick second copper layer 38 (or thermal conduction layer 46) that is electrically isolated, permits efficient heat transfer through a very thin printed circuit board 18.

Figure 5:
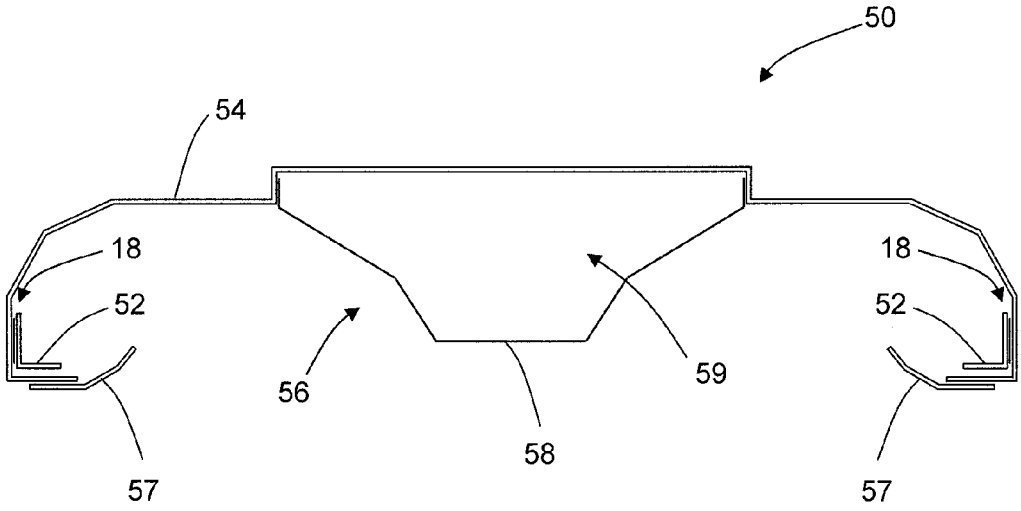
FIG. 5 is a cross-sectional view of a second embodiment of a luminaire having side heat sinking panels and a middle heat sinking panel, according to the present invention.
Figure 6:
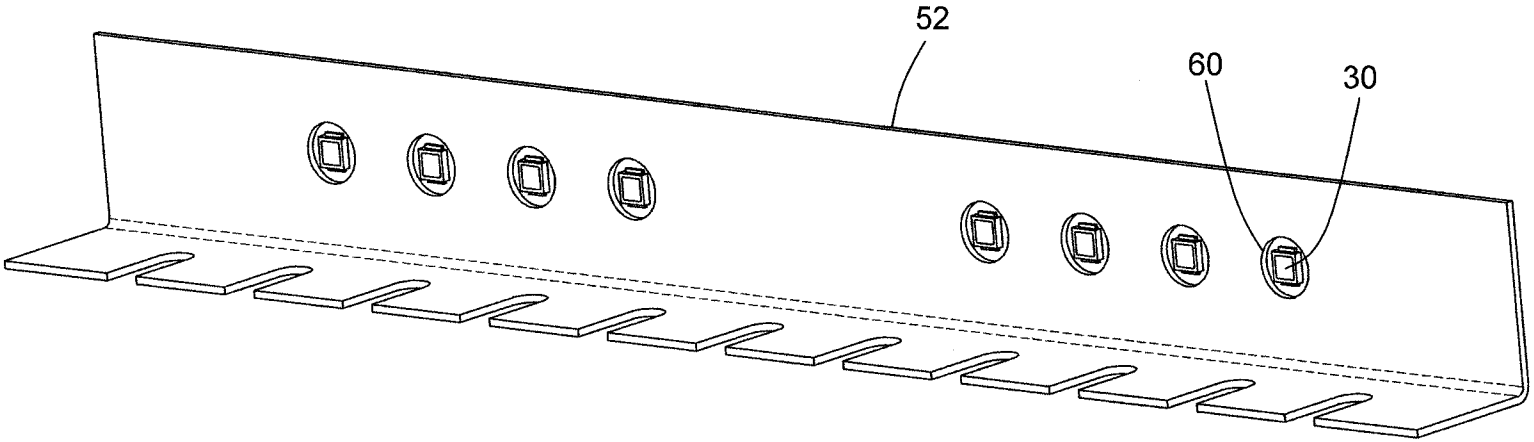
FIG. 6 is a perspective view of an embodiment of a side heat sinking panel having apertures, according to the present invention.

With further reference to FIGS. 5 and 6, the present invention also may be embodied in a luminaire 50 comprising a plurality of side heat sinking panels 52, a middle (or center) heat sinking panel 54 including a diffusely reflective surface 56, and a plurality of printed circuit boards 18. Each side heat sinking panel has a plurality of apertures 60. Each printed circuit board has an electrically-insulated back surface 20 and has a selectively electrically-insulated front surface 22 having exposed electrical contacts coupled to light emitting diodes 30. Each first printed circuit board is sandwiched between a respective side heat sinking panel and the middle heat sinking panel with a compressive force and with at least one light emitting diode associated with each aperture directing light toward the diffusely reflective surface for illumination of an area facing the diffusely reflective surface. In this embodiment, the circuit boards are on an inside surface of the middle heat sinking panel.

The plurality of printed circuit boards 18 each may be a flexible printed circuit board. Each light emitting diode 30 may emit at least 60 lumens of visible light using an electrical input of 1.5 watts. The luminaire may further include a lens 57 in at least a portion of an illumination opening formed by the middle heat sinking panel 54 and the plurality of side heat sinking panels 52. Surfaces of the heat sinking panels, 52 and 54, and the lens 57, may have holes to allow airflow for better convective cooling.

At least a portion of the diffusely reflective surface 56 may have a curved shape, a faceted shape, or a shape of a pyramid. In addition, at least a portion of the diffusely reflective surface may be an enclosure cover 58 that may be removable from the middle heat sinking panel 54 for access to an enclosure 59. The enclosure may house power and control equipment and connections. The removable enclosure cover allows access to the power and control equipment and connections through the illumination opening, e.g., from below a ceiling mounted luminaire 50.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A luminaire, comprising:

a plurality of side heat sinking panels;

a middle heat sinking panel having a plurality of side apertures and having a diffusely reflective surface;

a plurality of printed circuit boards, each having an electrically-insulated back surface and having a selectively electrically-insulated front surface having exposed electrical contacts coupled to light emitting diodes;

each first printed circuit board being sandwiched between a respective side heat sinking panel and the middle heat sinking panel with a compressive force and with at least one light emitting diode associated with each side aperture directing light toward the diffusely reflective surface for illumination of an area facing the diffusely reflective surface.

2. A luminaire as defined in claim 1, wherein the plurality of printed circuit boards are each a flexible printed circuit board.

3. A luminaire as defined in claim 1, wherein each printed circuit board has a solder mask layer on the front surface, a front copper layer comprising the exposed electrical contacts, an electrically insulative polyimide layer, a rear copper layer, and an solder mask layer on the back surface.

4. A luminaire as defined in claim 3, wherein the front copper layer comprising at least one thermal contact for thermally coupling to a light emitting diode.

5. A luminaire as defined in claim 3, wherein the rear copper layer has an area substantially equal to an area of the electrically-insulated back surface.

6. A luminaire as defined in claim 3, wherein each of the front and rear copper layers comprise 3 ounce per square foot copper.

7. A luminaire as defined in claim 3, wherein the front and rear copper layers are not in electrical contact with the heat sinking panels.

8. A luminaire as defined in claim 1, wherein each printed circuit board has a solder mask layer on the front surface, a front copper layer comprising the exposed electrical contacts, an electrically insulative polyimide layer, and a rear aluminum layer on the back surface.

9. A luminaire as defined in claim 1, wherein each light emitting diode emits at least 60 lumens of visible light using an electrical input of 1.5 watts.

10. A luminaire, comprising:

a plurality of side heat sinking panels, each side heat sinking panel having a plurality of apertures;

a middle heat sinking panel including a diffusely reflective surface;

a plurality of printed circuit boards, each having an electrically-insulated back surface and having a selectively electrically-insulated front surface having exposed electrical contacts coupled to light emitting diodes;

each first printed circuit board being sandwiched between a respective side heat sinking panel and the middle heat sinking panel with a compressive force and with at least one light emitting diode associated with each aperture directing light toward the diffusely reflective surface for illumination of an area facing the diffusely reflective surface.

11. A luminaire as defined in claim 10, wherein the plurality of printed circuit boards are each a flexible printed circuit board.

12. A luminaire as defined in claim 10, wherein at least a portion of the diffusely reflective surface has a curved shape.

13. A luminaire as defined in claim 10, wherein at least a portion of the diffusely reflective surface has a faceted shape.

14. A luminaire as defined in claim 10, wherein at least a portion of the diffusely reflective surface has a shape of a pyramid.

15. A luminaire as defined in claim 10, wherein at least a portion of the diffusely reflective surface comprises an enclosure cover, and is removable from the middle heat sinking panel for access to an enclosure.

16. A luminaire as defined in claim 10, further comprising a lens in at least a portion of an illumination opening formed by the middle heat sinking panel and the plurality of side heat sinking panels.

17. A luminaire, comprising:

a heat sinking panel including a diffusely reflective surface; and a plurality of printed circuit boards, each printed circuit board having a selectively electrically-insulated front surface having exposed electrical contacts coupled to light emitting diodes, and each printed circuit board having a back surface that is electrically isolated from the front surface;

wherein the back surface of each printed circuit board is thermally coupled to the heat sinking panel with the light emitting diodes directing light toward the diffusely reflective surface for illumination of an area facing the diffusely reflective surface.

18. A luminaire as defined in claim 17, wherein at least a portion of the diffusely reflective surface has a curved shape.

19. A luminaire as defined in claim 17, wherein at least a portion of the diffusely reflective surface has a faceted shape.

20. A luminaire as defined in claim 17, wherein at least a portion of the diffusely reflective surface has a shape of a pyramid.

* * * * *